US009770056B2

(12) United States Patent
Sung

(10) Patent No.: US 9,770,056 B2
(45) Date of Patent: Sep. 26, 2017

(54) PAD FOR BRASSIERE

(71) Applicant: Youngone Outdoor Corporation, Seongnam (KR)

(72) Inventor: Ki Hak Sung, Seoul (KR)

(73) Assignee: Youngone Outdoor Corporation, Seongnam (KR)

( * ) Notice: Subject to any disclaimer, the term of this patent is extended or adjusted under 35 U.S.C. 154(b) by 0 days.

(21) Appl. No.: 15/093,114

(22) Filed: Apr. 7, 2016

(65) Prior Publication Data

US 2017/0172220 A1 Jun. 22, 2017

(30) Foreign Application Priority Data

Dec. 16, 2015 (KR) ..... 10-2015-0179887

(51) Int. Cl.
*A41C 3/00* (2006.01)
*A41C 3/14* (2006.01)

(52) U.S. Cl.
CPC ..... *A41C 3/144* (2013.01); *A41C 3/0085* (2013.01)

(58) Field of Classification Search
CPC ..... A41C 3/0028; A41C 3/065; A41C 3/0057; A41C 3/105; A41C 3/144; A41C 3/14; A41C 3/10
USPC ..... 450/37, 39, 54–57, 41, 81, 88; 2/267, 2/268
See application file for complete search history.

(56) References Cited

U.S. PATENT DOCUMENTS 4,047,534 A * 9/1977 Thomaschefsky .... A61F 13/141 450/37
4,091,819 A * 5/1978 Huber ..... A41C 3/10 450/55
5,522,892 A * 6/1996 Lin ..... A41C 3/144 450/39
6,080,037 A * 6/2000 Lee ..... A41C 3/105 2/67
6,306,006 B1 * 10/2001 Cheng ..... A41C 3/10 2/267
6,419,548 B1 * 7/2002 Wittes ..... A41C 3/065 2/267
7,152,606 B1 * 12/2006 Schindler ..... A41C 3/065 128/889
7,229,335 B2 * 6/2007 Davis ..... A41C 3/065 450/54
8,118,639 B1 * 2/2012 Boon ..... A41C 3/144 450/37

(Continued)

*Primary Examiner* — Gloria Hale
(74) *Attorney, Agent, or Firm* — Patent Office of Dr. Chung Park

(57) ABSTRACT

A pad for a brassiere includes: a pair of pad members having punched portions passing through inner and outer sides of the pair of pad members; an inner cover member provided on one surface that is in contact with a body in the pad member; and an outer cover member provided on the other surface of the pad member. The brassiere discharges sweat through the punched portions in a pad member for a ventilation function, may be quickly dried and absorb moisture when a wearer sweats, may correct a shape of the breast of a woman so as to feel aesthetic beauty by using a thickness reinforced pad shaped in a circle or a banana, and may decrease press applied to a nipple of a body by increasing a density of the punched portions in a region corresponding to the nipple to improve wearing sensation.

11 Claims, 5 Drawing Sheets

(56) References Cited

U.S. PATENT DOCUMENTS

| | | | | |
|---|---|---|---|---|
| 8,517,794 | B2 * | 8/2013 | Thompson | A41B 17/00 450/81 |
| 9,238,345 | B2 * | 1/2016 | Noda | B32B 3/266 |
| 2003/0236053 | A1 * | 12/2003 | Martz | A41C 3/144 450/39 |
| 2005/0255789 | A1 * | 11/2005 | Gaudet | A41C 3/0057 450/41 |
| 2007/0239212 | A1 * | 10/2007 | Schneider | A43B 1/0045 607/2 |
| 2008/0194180 | A1 * | 8/2008 | Warren | A41C 3/10 450/57 |
| 2009/0117824 | A1 * | 5/2009 | Jian | A41C 3/14 450/38 |
| 2011/0065360 | A1 * | 3/2011 | Francis | A61J 13/00 450/81 |
| 2012/0231700 | A1 * | 9/2012 | Chou | A41C 3/0028 450/39 |
| 2013/0095729 | A1 * | 4/2013 | Chang | A41C 3/065 450/81 |

* cited by examiner

PAD FOR BRASSIERE

CROSS-REFERENCE TO RELATED APPLICATIONS

This application claims priority to and the benefit of Korean Patent Application No. 10-2015-0179887 filed in the Korean Intellectual Property Office on Dec. 16, 2015, the entire contents of which are incorporated herein by reference.

TECHNICAL FIELD

The present invention relates to a pad for a brassiere, and more particularly, to a pad for a brassiere for a woman, which has ventilation and provides an esthetic effect, and minimizes usage inconvenience.

BACKGROUND ART

A development object of a typical brassiere is to provide external beauty and improve comfort, and recently, a brassier manufactured based on a principle of an air bag and simultaneously using an attached insertion material has been recently developed to receive responses of women having the small breasts, and various products, such as a brassier for collecting the breasts inward or supporting up breasts, have been substantially released. Further, a brassier made of a mesh has also come to the market, but nipples protrude from upper clothes to the outside and are recognized, so that general women cannot frequently wear the brassier made of the mesh.

The various on-sale brassieres pursue beauty in a design and comfort, but have a problem in that ventilation is poor, nipples are pressed, and sweat is not smoothly discharged, except for a brassiere made of a mesh. The aforementioned problems may be reduced in a brassiere made of a mesh as a matter of course, but the brassiere made of the mesh creates an excessively erotic atmosphere, so that the brassiere made of the mesh is difficult to be generalized, and the brassiere made of the mesh also presses the breasts, so that it is impossible to desirably solve the press applied to the nipples.

In this respect, a brassiere, which is formed with recessed parts provided with spaces, into which nipples are insertable, at inner sides thereof by performing a press operation on vertexes of cups or pads to allow the nipples to be positioned inside the recessed parts when a woman wears the brassiere and release the press of the nipples, has been conceived, but when a woman wears upper clothes, the protruding parts also press the nipples, so that the conceived brassier cannot substantially release a depression of the nipples and cannot discharge sweat on the nipples and the breasts well.

SUMMARY OF THE INVENTION

The present invention provides a brassiere for woman, which has a ventilation function to easily discharge sweat when a woman wears the brassiere.

Further, the present invention provides a brassiere, which has a correction function of collecting shapes of breasts of a woman so as to improve an aesthetic effect when a woman wears the brassiere.

Further, the present invention provides a brassiere, which has excellent heat reservance and is capable of releasing inconvenience, such as the press of the nipples of a body, when a woman wears the brassiere.

An exemplary embodiment of the present invention provides a pad for a brassiere, including: a pair of pad members formed with punched portions passing through inner and outer sides of the pair of pad members; an inner cover member provided on one surface that is in contact with a body in the pad member; and an outer cover member provided on the other surface of the pad member.

The punched portions may be formed in the pad member in a predetermined interval.

The larger number of punched portions may be formed in a region corresponding to a nipple of a body in the pad member, compared to other regions.

A ratio of an entire area of the punched portions within the corresponding region to an area of the region corresponding to the nipple of the body may be 8% to 24%.

The pad member may be formed of the same material as that of the pad member and include a connection part connecting the pad members.

The connection part may be integrally formed with the pad members.

The connection part may be formed with punched portions passing through internal and external sides of the connection part.

The pad member may have a thickness radially increased from a center of the pad member to correct a shape of a breast when a user wears the pad.

The pad member may have a thickness increased from a center of the pad member in an outer down direction to correct a shape of a breast when a user wears the pad.

The inner cover member and the outer cover member may be formed of an antibiotic material.

The outer cover member may include a slip preventing member on an external surface of the outer cover member.

The slip preventing member may be formed in a shape of a plurality of dots. The slip preventing member may be formed of any one material between silicon and a synthetic resin.

The pad for the brassiere according to the present invention may easily discharge sweat, and may be quickly dried and absorb moisture when a user sweats while the user wears the brassiere by forming the punched portions in the pad members for a ventilation function.

Further, the pad for the brassiere according to the present invention uses the circular or banana-shaped thickness reinforced pad to correct a shape of a breast of a woman so as to improve an aesthetic effect when a woman wears the brassiere.

Further, the pad for the brassiere according to the present invention may decrease press applied to a nipple of a body when a woman wears the brassiere by increasing a density of punched portions in a region corresponding to the nipple, thereby improving wearing sensation.

Further, the pad for the brassiere according to the present invention includes a plurality of dots formed of silicon on an external surface of the outer cover member, particularly, an outer lower side of the outer cover member, so that, it is possible to prevent the corresponding pad from slipping and being separated when a woman wears the brassiere by inserting the pad into the brassiere, stably support the breast by preventing the pad from moving within the brassier during strenuous exercise, and fix the brassiere and prevent an external shape of the brassiere from being deformed.

DETAILED DESCRIPTION

Figure 1:
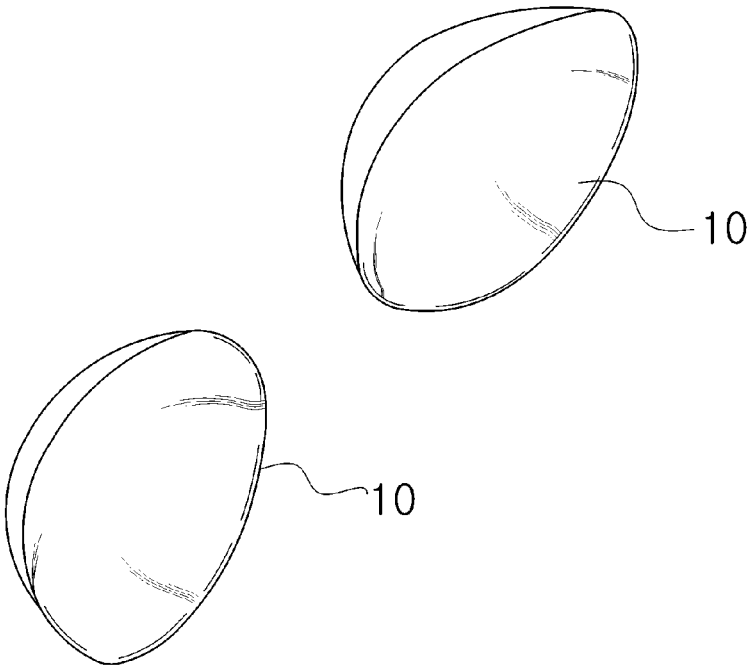
FIG. 1 is a perspective view illustrating separated pads for a brassiere according to an exemplary embodiment of the present invention.

Hereinafter, exemplary embodiments of the present invention will be described with reference to the accompanying drawings. Unless there is a special definition or mention, terms indicating a direction used in the present description are based on a state illustrated in the drawing. Further, the same reference numeral designates the same member throughout each exemplary embodiment. In the meantime, for convenience of the description, a thickness or a size of each constituent element illustrated in the drawings may be exaggerated, and it does not mean that the constituent element needs to be actually configured with a corresponding size or a ratio between the elements.

A pad for a brassiere for a woman according to an exemplary embodiment of the present invention will be described with reference to FIGS. 1 and 2. FIG. 1 is a perspective view illustrating separated pads for a brassiere according to an exemplary embodiment of the present invention, and FIG. 2 is a perspective view illustrating integrated pads for a brassiere according to an exemplary embodiment of the present invention.

The brassieres according to the exemplary embodiments of the present invention include pads 10 and 10*a*, respectively.

Figure 2:
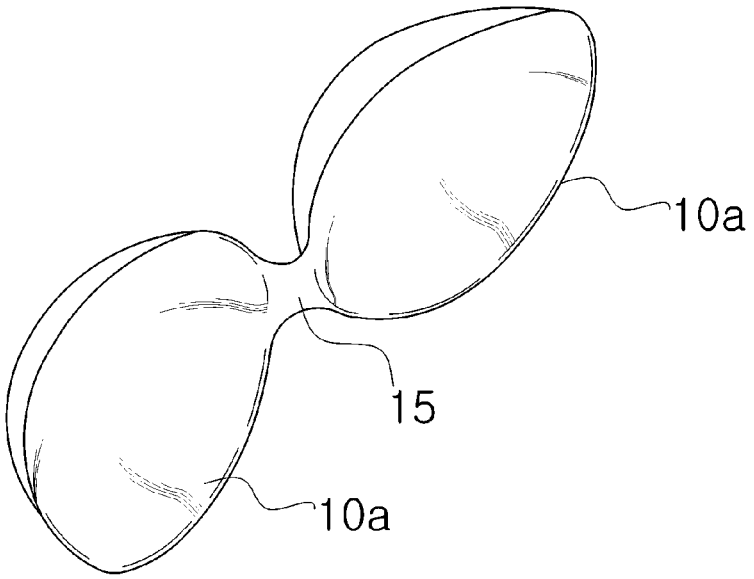
FIG. 2 is a perspective view illustrating integrated pads for a brassiere according to an exemplary embodiment of the present invention.

As illustrated in FIG. 1, the pads 10 according to the exemplary embodiment may be provided in left and right separate forms, respectively, and as illustrated in FIG. 2, the pads 10*a* according to the exemplary embodiment may be provided in an integrated form connected through a connection part 15 at a center thereof.

The pads 10 and 10*a* provided as described above may be worn by adding separate strings of the brassiere to the pads 10 and 10*a*, or may be used by a method of inserting the pads 10 and 10*a* into separate configurations, for example, another brassiere or an external cover forming an external appearance of the brassiere.

Hereinafter, for convenience of the description, detailed descriptions of the elements, other than the elements implementing the technical characteristic of the present invention, will be omitted below.

Figure 3:
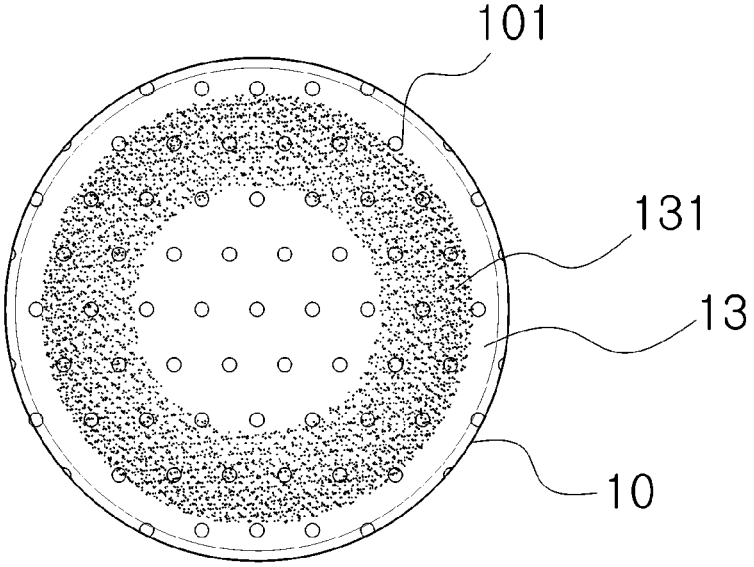
FIGS. 3 and 4 are a front side view and a cross-sectional view schematically illustrating a circular pad according to an exemplary embodiment of the present invention, respectively.
Figure 4:
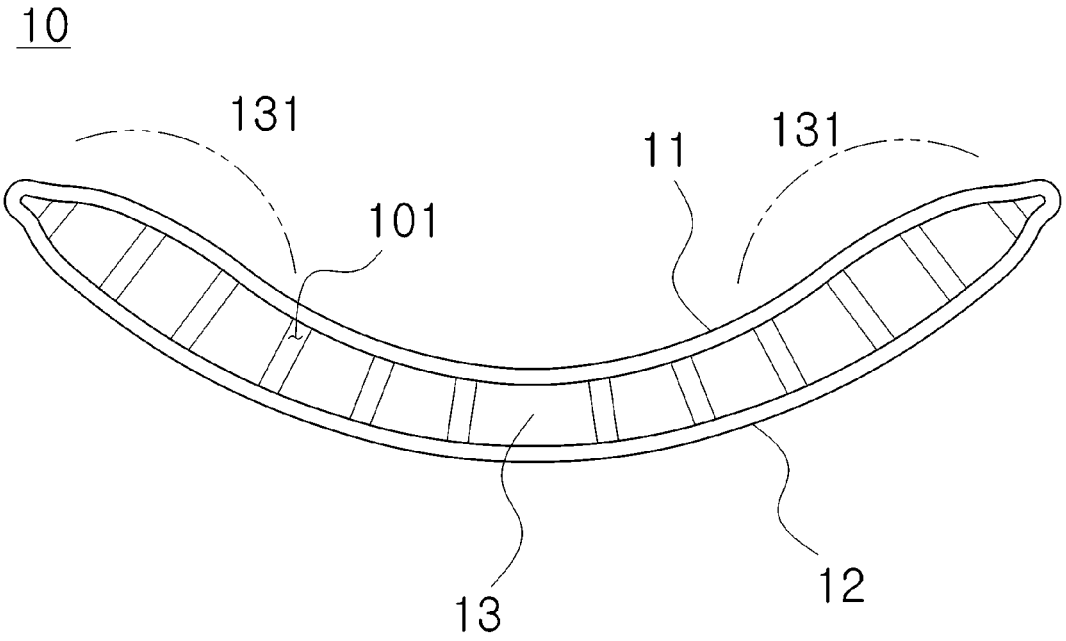

A circular pad having a correction function among the separate-type pads will be described with reference to FIGS. 3 and 4. FIGS. 3 and 4 are a front side view and a cross-sectional view schematically illustrating a circular pad according to an exemplary embodiment of the present invention, respectively.

As illustrated in FIGS. 3 and 4, the pad 10 according to the present exemplary embodiment is formed in a shape close to a hemisphere, and includes a pad member 13, an inner cover member 11, and an outer cover member 12.

The pad member 13 is an element forming a general shape of the pad 10, and is formed of an elastic material capable of enabling the pad member 13 to maintain a uniform shape. The pad member 13 is formed with punched portions 101 passing from an internal surface thereof, which are in contact with a body, to an external surface thereof. The punched portions 101 may be formed on a front surface of the pad member 13 in a predetermined interval.

The punched portions 101 have a ventilation function, so that when a woman wears the pad 10 according to the present exemplary embodiment, the punched portions 101 enable air to be well ventilated between internal and external sides of the pad 10, thereby preventing sweating and allowing the sweat from being discharged well.

Further, the pad 10 according to the present exemplary embodiment includes a thickness reinforcing part 131. The thickness reinforcing part 131 is formed so that a thickness thereof is radially increased from a center portion of the pad 10. The thickness reinforcing part 131 serves to collect and push up the breast of the woman to make the woman be glamorously looked.

The inner cover member 11 has cooling performance and thermal reservance when is worn to obtain a thermal reservance effect and improve wearing sensation, and the inner cover member 11 and the outer cover member 12 may be formed of an antibiotic material to enable the woman to hygienically wear the pad, and may be formed of a moisture absorbing and quickly drying material.

Figure 5:
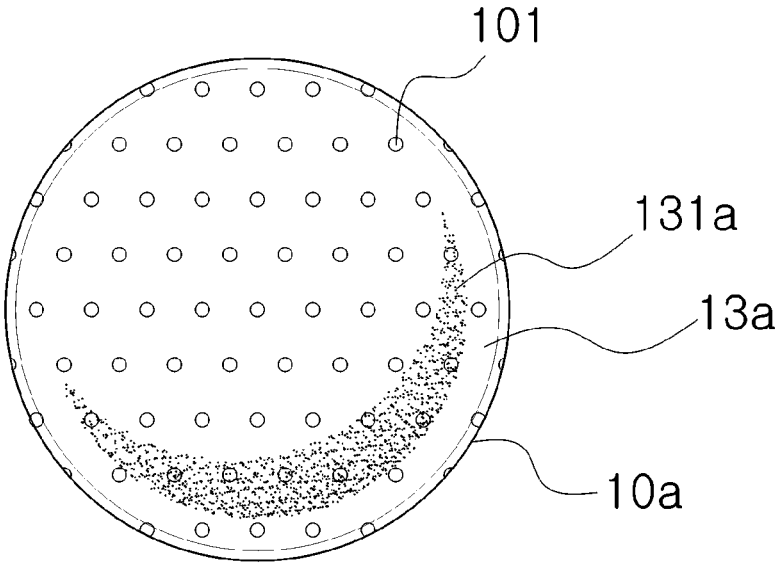
FIGS. 5 and 6 are a front side view and a cross-sectional view illustrating a banana-shaped pad according to another exemplary embodiment of the present invention, respectively.
Figure 6:
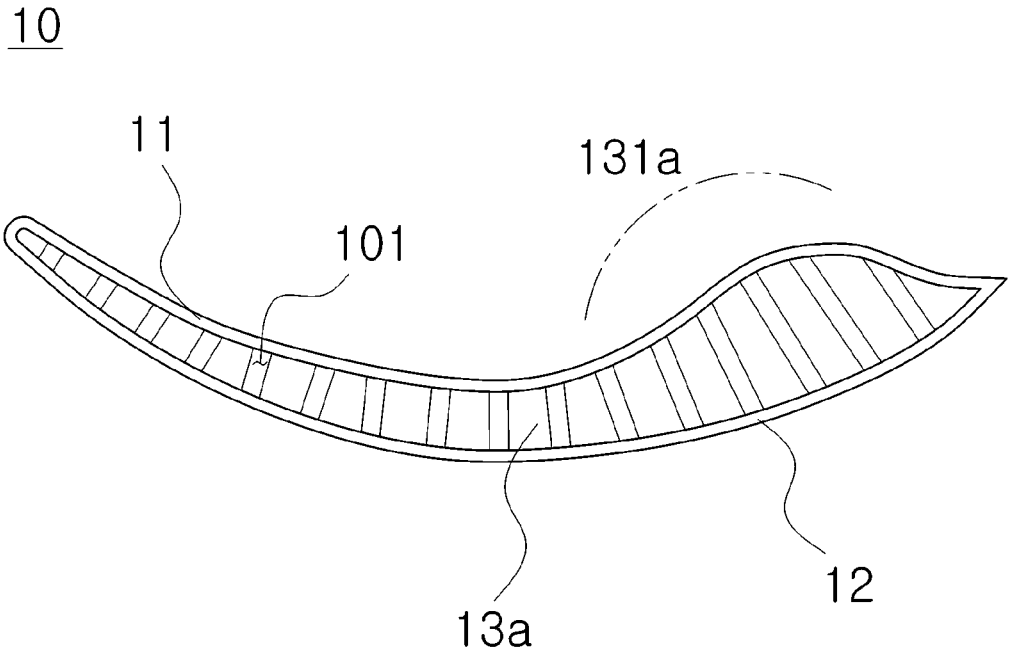

A banana-shaped pad having a correction function among the separate-type pads will be described with reference to FIGS. 5 and 6. FIGS. 5 and 6 are a front side view and a cross-sectional view illustrating a banana-shaped pad according to another exemplary embodiment of the present invention, respectively.

A pad 10*a* according to the present exemplary embodiment is different from the aforementioned pad 10 in view of a shape of the pad member. Particularly, a pad member 13*a* according to the present exemplary embodiment is formed with a thickness reinforcing part 131*a*, which is formed to have a thickness increased from a center thereof in an outer-down direction. That is, the pad 10*a* applied to a left side of a wearer is formed in a state where the thickness reinforcing part 131*a* leans in a right-down direction based on a front surface as illustrated in FIG. 5. The pad 10*a* formed with the thickness reinforcing part 131*a* may serve to collect the breast to the center while pushing up the breast of a woman wearing the pad 10*a*.

That is, the pad 10*a* according to the present exemplary embodiment has an advantage in that an entire thickness of the pad 10*a* is not excessively increased and a body figure correction effect of the pad 10*a* is larger than that of the existing brassiere.

The configurations of other elements, that is, the punched portion 101, are applied identically to the case of the aforementioned exemplary embodiment.

Figure 7:
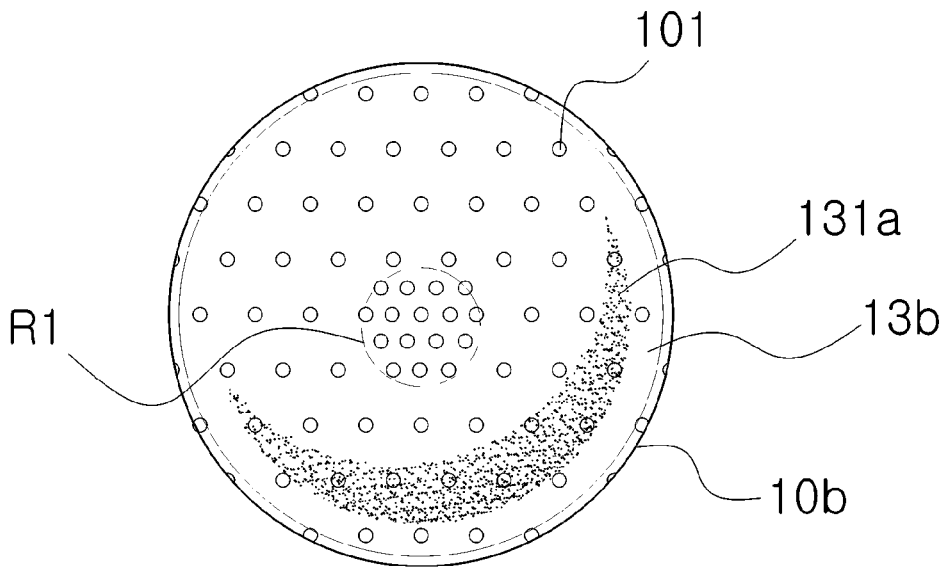
FIG. 7 is a front side view schematically illustrating a pad for a brassiere according to another exemplary embodiment of the present invention.

A pad for a brassiere according to another exemplary embodiment will be described with reference to FIG. 7. FIG. 7 is a front side view schematically illustrating a pad for a brassiere according to another exemplary embodiment of the present invention.

In a pad 10*b* according to the present exemplary embodiment, a center portion, that is, a region R1 corresponding to a nipple of a woman wearing the pad 10*b*, is different from other regions in the number of punched portions 101. In the pad 10*b* according to the present exemplary embodiment, the number of punched portions 101 in the region R1 is larger than those of other regions. When the larger number of punched portions is formed in a partial region of the pad, resistance against to force applied to the outside is decreased compared to a case where the smaller number of punched portions is formed. Accordingly, when the woman wears the pad 10*b* according to the present exemplary embodiment, resistance applied to the protruding nipple is decreased, so that wearing sensation may be improved.

Particularly, a ratio of an entire area of the punched portions within the region R1 to the entire area of the region R1 may be 8% to 24%. When the entire area of the punched portions within the region R1 to the entire area of the region R1 is 8% or less, a decrease in resistance by the pad 10*b* is slight, so that it is difficult to achieve an effect of improving wearing sensation, and when the entire area of the punched portions within the region R1 to the entire area of the region R1 is 24% or more of the entire area of the region R1, wearing sensation is improved, but there is a problem in that durability is decreased and it is difficult to maintain a shape of the pad.

In the meantime, a ventilation level (Pa) of the pad 10*b* according to the present exemplary embodiment and ventilation levels of similar products of other companies were measured, and the measured values are represented in Table 1.

TABLE 1

| Classification | Ventilation level (Pa) |
|---|---|
| Exemplary embodiment | 132 Pa |
| Comparative Example 1 | 71.1 Pa |
| Comparative Example 2 | 59 Pa |
| Comparative Example 3 | 57.6 Pa |
| Comparative Example 4 | 44.4 Pa |
| Comparative Example 5 | 40.1 Pa |

As can be seen in Table 1, when the plurality of punched portions 101 is formed, and particularly, the relatively larger number of punched portions 101 is formed in the region R1, it is possible to obtain an effect in that wearing sensation is improved and the ventilation level is increased.

Integrated pads for a brassiere according to another exemplary embodiment will be described with reference to FIG. 8.

Figure 8:
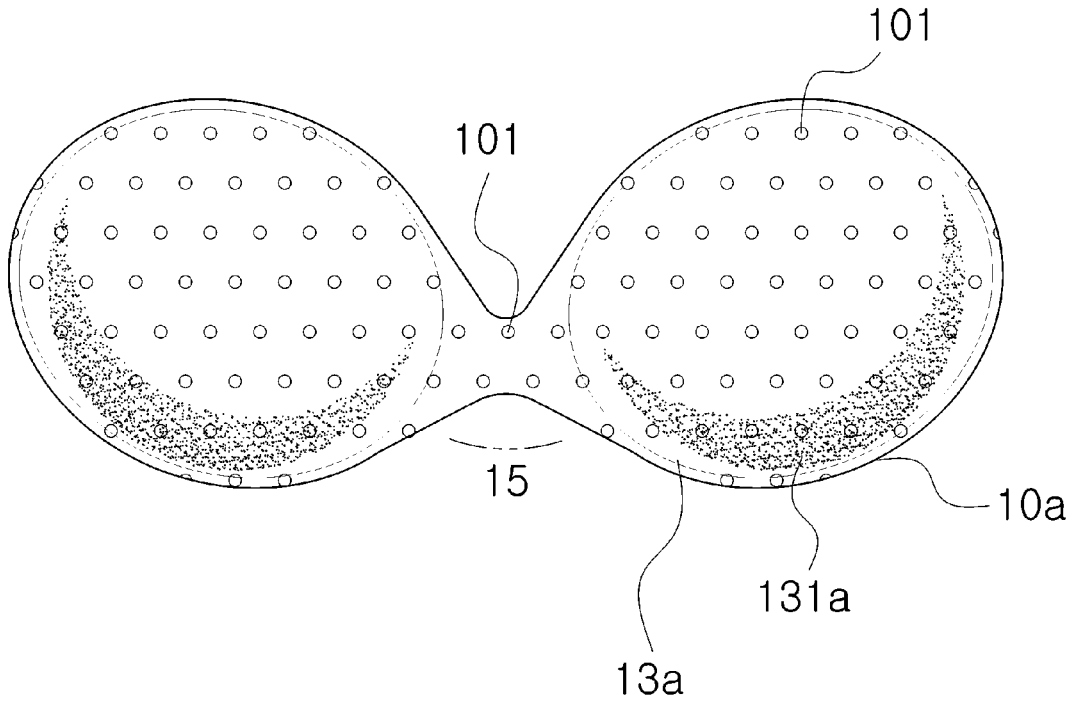
FIG. 8 is a front side view illustrating integrated pads including banana-shaped correction pad members.

FIG. 8 is a front side view illustrating integrated pads including banana-shaped correction pad members.

Pads 10*a* according to the present exemplary embodiment are formed in an integrated form. Particularly, the pair of pads 10*a* is connected through a connection part 15 at a center thereof.

In this case, the connection part 15 is formed of the same material as that of a pad member 13*a*, and may be integrally formed with the pad member 13*a*.

Further, punched portions 101 may be formed in the connection part 15. It is possible to improve ventilation between a cleavage by minimizing a width of the connection part 15, and add ventilation by additionally forming the punched portion 101.

Figure 9:
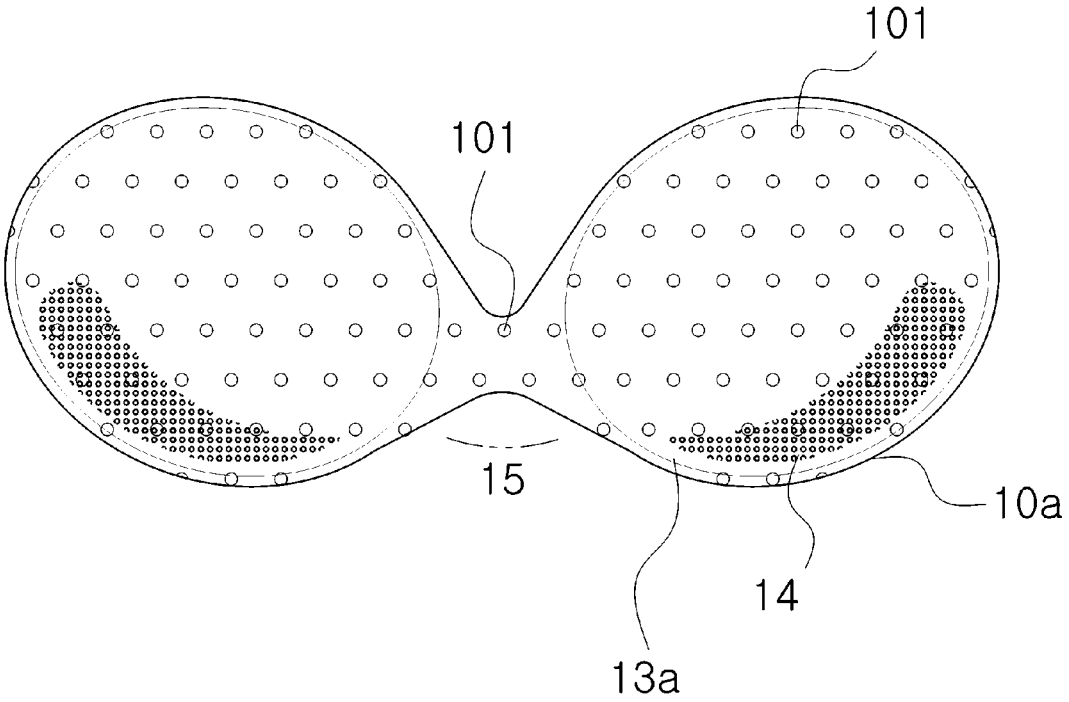
FIG. 9 is a front side view schematically illustrating pads for a brassiere according to another exemplary embodiment of the present invention.

Pads for a brassiere according to another exemplary embodiment will be described with reference to FIG. 9. FIG. 9 is a front side view schematically illustrating pads for a brassiere according to another exemplary embodiment of the present invention.

Pads 10*a* for a brassiere according to the present exemplary embodiment may include slip preventing members 14 on external surfaces of outer cover members 13*a*.

The slip preventing member 14 is formed of silicon or a synthetic resin material having large frictional force to improve frictional force against other objects, thereby serving to prevent the pad 10*a* from slipping. For example, when the pad for the brassiere according to the present exemplary embodiment is inserted into another brassiere and used, the slip preventing member 14 formed on the outer cover member 13*a* is in contact with an inner surface of another brassiere and prevents the pad from freely moving or being separated by frictional force.

That is, the slip preventing member 14 formed on the outer cover member 13*a* prevents the pad 10*a* from slipping and being separated from the brassiere, into which the pad 10*a* is inserted, prevents the pad 10 from moving within the brassiere during strenuous exercise and stably supports the breast, and fixes the brassiere and prevents an external shape of the brassiere from being deformed.

Further, the slip preventing member 14 of the pad 10*a* for the brassiere according to the present exemplary embodiment may be formed in a shape of a plurality of dots on an external surface of the outer cover member, particularly, an external lower side of the outer cover member.

In the above, the exemplary embodiments of the present invention have been described, but the technical spirit of the present invention is not limited to the aforementioned exemplary embodiments, and various modifications may be made within the scope of the technical spirit of the present invention embodied in the claims.

What is claimed is:

1. A pad for a brassiere, comprising:

a pair of pad members configured to be inserted into an external cover of a brassiere, each of the pad members having a convex surface and a concave surface that is configured to face a wearer's body and including punched portions that each extend between the convex surface and the concave surface;

an inner cover member provided on the concave surface;

an outer cover member provided on the convex surface; and a slip preventing member disposed on an external surface of the outer cover member and having a shape of a plurality of dots and increasing a friction force between the pair of pad members and the external cover of the brassiere.

2. The pad of claim 1, wherein the punched portions are formed at a predetermined interval.

3. The pad of claim 1, wherein a number density of the punched portions in a region corresponding to a nipple of the wearer's body is higher than a number density of the punched portions at outside of the region.

4. The pad of claim 3, wherein a ratio of a total area of the punched portions within the region to an area of the region is 8% to 24%.

5. The pad of claim 1, further comprising a connection part formed of a same material as the pair of pad members and connecting the pair of pad members to each other.

6. The pad of claim 5, wherein the connection part is integrally formed with the pair of pad members.

7. The pad of claim 5, wherein the connection part is formed with punched portions passing through internal and external sides of the connection part.

8. The pad of claim 1, wherein each of the pad members has a thickness radially increased from a center thereof to correct a shape of a breast of the wearer.

9. The pad of claim 1, wherein each of the pad members has a thickness increased from a center thereof in an outer down direction to correct a shape of a breast of the wearer.

10. The pad of claim 1, wherein the inner cover member and the outer cover member include an antibiotic material.

11. The pad of claim 1, wherein the slip preventing member is formed of a material selected from the group consisting of silicon and a synthetic resin.

* * * * *